United States Patent [19]

Blonde

[11] 3,974,995

[45] Aug. 17, 1976

[54] MEANS FOR FORMING A BUILDING FACADE

[76] Inventor: Guy Blonde, 56, avenue Aristide Briand, 95530 La Frette sur Seine, France

[22] Filed: Aug. 26, 1974

[21] Appl. No.: 500,629

[52] U.S. Cl. ..... 249/19; 182/57; 182/82; 249/210

[51] Int. Cl.[2] ..... E04G 13/06

[58] Field of Search ..... 249/13, 18, 19, 23–25, 249/210–211; 182/57, 82

[56] References Cited

UNITED STATES PATENTS

| | | | |
|---|---|---|---|
| 2,658,803 | 11/1953 | Long et al. | 182/82 |
| 3,612,470 | 10/1971 | Car et al. | 249/19 |
| 3,679,026 | 7/1972 | Hansen et al. | 182/57 |

FOREIGN PATENTS OR APPLICATIONS

| | | | |
|---|---|---|---|
| 726,645 | 6/1932 | France | 182/57 |
| 191,400 | 9/1964 | Sweden | 182/82 |

*Primary Examiner*—Francis S. Husar
*Assistant Examiner*—John McQuade
*Attorney, Agent, or Firm*—Robert B. Frailey

[57] ABSTRACT

A removable cast, form or "shuttering" is provided to form "in situ" from poured concrete the portion of an outside wall, of a building disposed between the sill of the window opening of one story and the upper part of the window opening of the story directly below it. The shuttering comprises a unitary combination handleable in a single operation of either assembly preparatory to pouring concrete, or disassembly after pouring. It includes all adjustment means necessary for adjusting the assembly in all directions, and does not require any alteration to the parts of the building already constructed. The shuttering, when assembled, is characterized by having its center of gravity disposed within the building, to provide a more stable equilibrium during pouring, and by having its center of gravity, upon disassembly, displaced to the outside of the building, to facilitate its ready removal with the aid of a crane, winch or other comparable lifting means.

The term "shuttering" is used herein to denote a removable cast, form or framing assembly for shaping poured concrete.

10 Claims, 7 Drawing Figures

MEANS FOR FORMING A BUILDING FACADE

SUMMARY OF THE INVENTION

The present invention concerns a wall "shuttering," that is to say, a framing or farm adapted to form "in situ," from poured concrete, the part of an outside facade comprised between the sill of window openings of one story and the upper part of the window openings of the story directly below. The facade member is disposed in front of the floor slab of the story under consideration.

To construct walls in poured material in situ there has been used up to the present four shuttering panels namely an upper interior vertical panel
an exterior vertical panel
a lower horizontal panel
and a lower interior vertical panel.

The first panel rests on the floor, and the three others rest on a cantilever platform mounted at the level of the floor under consideration. These different members are provisionally connected together by diverse tie rods and supports. It is to be understood that such wall shutterings are complicated and onerous as well as requiring portable platforms which necessitate mounting, taking down and multiple manhandling, at each stage. The major inconvenience in the use of such a platform is that it prevents, or makes difficult, supply by a crane to the facade at the stories situated below the wall shutterings. In fact, the cable of the crane cannot approach sufficiently near to the wall facade so that it can serve those stories. Moreover, there can be envisaged only with difficulty simultaneous pouring of several superimposed shutterings.

The present invention is adapted to minimize those inconveniences.

According to the present invention there is provided a wall shuttering characterized by the fact that it combines to a single assembly, handleable in a single operation, all the elements for the shuttering, including its means of support, its means for adjustment in all directions and its means of dissassembly which, in the main, are grouped at the same pouring level and which do not necessitate any alteration, such as the holes, in the parts of the building already constructed, the said shuttering being conceived so that when empty, that is to say without poured material.

in a position for shuttering, that is to say closed, the center of gravity is situated inside the facade to give the assembly a stable equilibrium.

in a position of "deshuttering," that is to say open, the center of gravity is displaced outside the wall facade to thus permit an easy gripping, without additional balancing skill, by means of a crane or winch or any other comparable lifting means.

More particularly, the shuttering includes a scaffolding or framework which has at least two spaced brackets extending outwardly of the surface of the wall facade when the shuttering is positioned precisely above the shuttering elements to furnish points of pendular suspension for the support for the outer shuttering elements, the said brackets being adapted to bear on three points of the floor and ceiling. The scaffolding also includes with each bracket a. an adjustable vertical wedged between the floor and ceiling, and b. a frame in the form of a half truss having the general shape of a right-angled triangle, of which the vertical side of the right angle supports the inner shuttering element above the floor and is located at the inside of the lower portion of the wall, and includes support means on the edge of the floor, the said support means being vertically adjustable, and of which the hypotenuse extends from the base of the prop beyond the upper part of the inner shuttering element for suspending pivotally the outer shuttering elements. The lower and inner end of the frame is connected to the base of the prop by a horizontal axis pivot parallel to the elements of the shuttering, each said pivot providing an adjustable means for displacing, perpendicularly to the inner shuttering element, the brackets and all that they support.

THE DRAWING

The present invention will be further illustrated, by way of example, with reference to the accompanying drawing, in which.

DETAILED DESCRIPTION OF THE PREFERRED EMBODIMENT OF THE INVENTION

Figure 1:
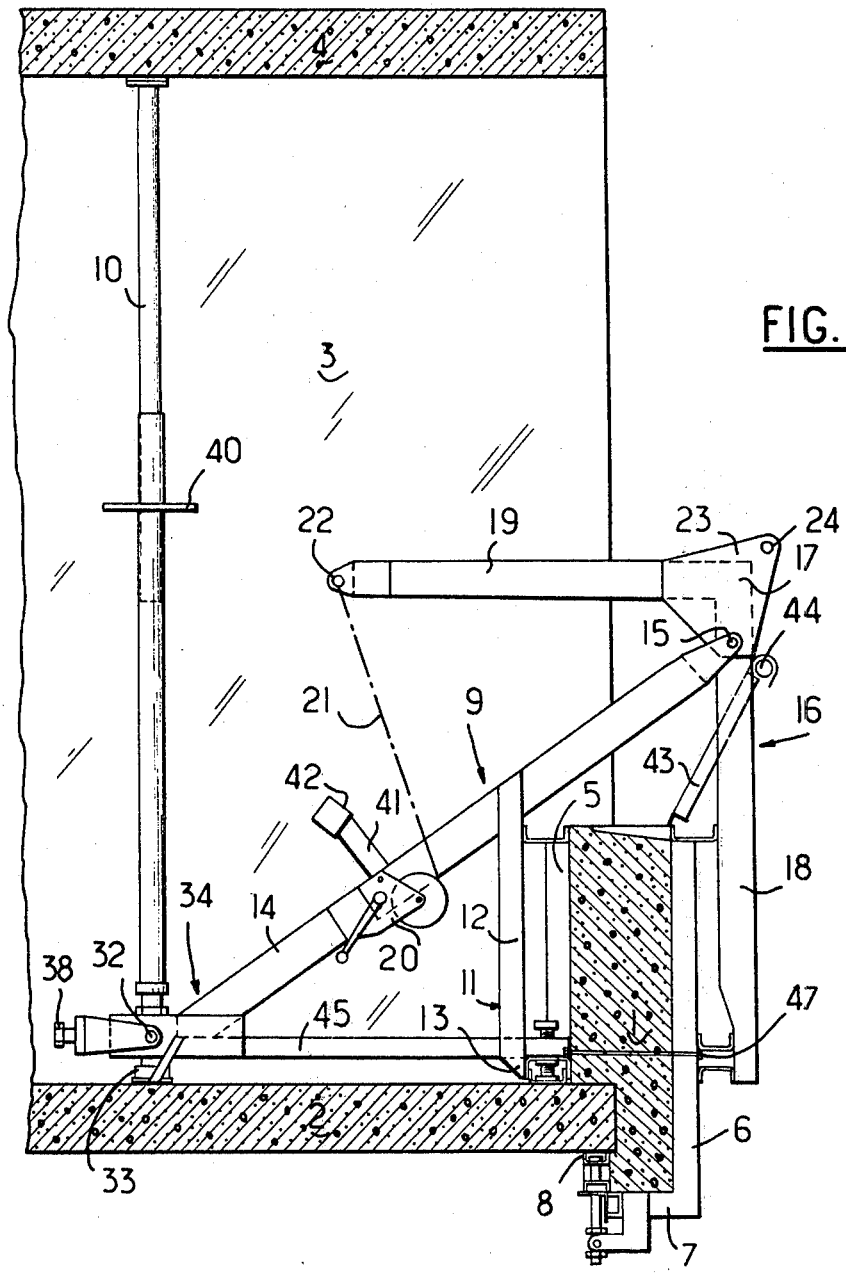
FIG. 1 is a view of the shuttering in side elevation in the shuttering position.

The removable shuttering of the invention is adapted to form a portion 1 (FIGS. 1, 3) of an outside wall on the edge of a floor 2 by pouring material, such as concrete, into the shuttering elements. The floor 2 forms part of a cavity 3, the ceiling of which is referenced 4. The cavity above the ceiling 4 can be in the course of construction or already constructed.

The shuttering includes a scaffolding which supports transverse elements or panels constituted as follows (FIG. 1):

one interior vertical panel 5,
one exterior vertical panel 6,
one horizontal panel 7 extending inward from the bottom of panel 6, and
one lower swingable panel 8 supported by panel 7.

Figure 7:
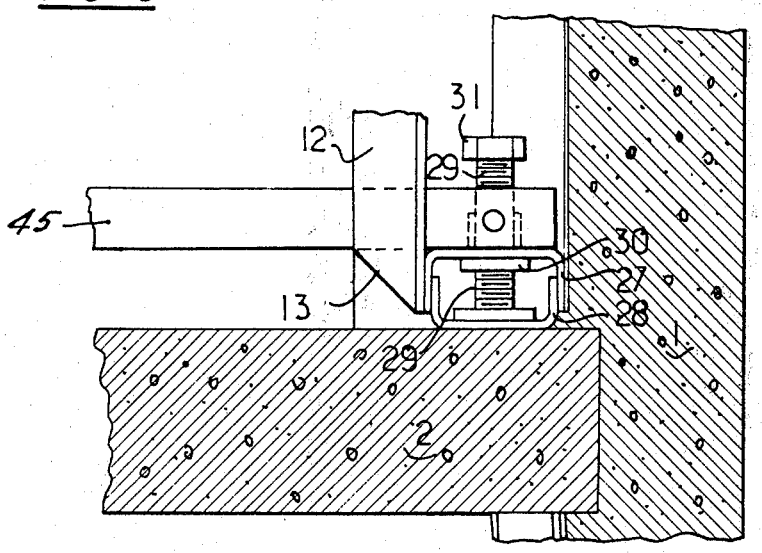
FIG. 7 is a detailed view in side elevation of the vertically adjustable support of the shuttering relative to the floor.

The panels 5, 6, 7, 8 provide a mold for poured concrete to form wall portion 1. The scaffolding includes at least two transversely spaced brackets 9 extending outwardly of the wall 1 when the shuttering is in place, directly above the panels 5, 6, 7 and 8. The scaffolding also includes for each bracket 9 an adjustable vertical prop 10, held between the floor 2 and the ceiling 4, and a frame 11 in the form of a half truss having the general shape of a right-angled triangle. Each assembly 11 has a vertical side 12 of the right angle which supports the panel 5, a corner 13 located at the inside of the lower portion of the wall, and a hypotenuse 14 which extends from the base of the prop 10 past the upper part of the panel 5 to the outside of the building to provide a horizontal pivot 15 for the support 16 of the panels 6, 7 and 8. The support 16 for the panels 6, 7 and 8 is a right-angled member pivotable at 15 a horizontal axis parallel to the panels 5, 6, 7 and 8. The support 16 has a lower side member 18 supporting the panel 6, a corner 17 and an upper side member 19 directed towards the inside of the building and serving as a balance, at the end of which force can be applied vertically, to regulate the position of the outer panels 6, 7 and 8, by means of a winch 20 operating on a cable 21 which is hooked to the end 22 of the side member 19. The corner 17 mounts a gusset 23 with a hooking point 24 disposed as far as possible to the outside of the building and adapted to receive the hook 25 (FIG. 3) at the end of the cable 26 of the crane (not shown). The panel 8 is pivotally connected to the panel 7 and can be locked perpendicularly thereto while having capacity for vertical adjustment to adapt to the thickness of the floor 2. For this reason it is called a "swinging panel." A simple way of making this pivoting is to provide an axis integral with the panel 7 which crosses the supports of the panel 8 having elongated holes parallel to the shuttering face of the panel 8, in a manner to effect vertical play thereof. The locking in position can be effected simply by bolts tightening the panel 8 against the panel 7. Each bracket 9 includes the hypotenuse 14, vertical side 12 and horizontal member 45 of a frame 11. Each vertical side 12 of each frame 11 is composed of a pair of spaced angle irons (FIG. 7) disposed on opposite sides of the hypotenuse 14 and horizontal member 45 of the frame.

The corners 13 have adjustable support means disposed on the upper part of the floor 2 comprising two transverse U-shaped irons 27, 28 (FIG. 7), the shanks of which are turned towards each other and engaged so that they form a box and can slide with slight play one within the other. The upper iron 27 is rigidly fixed to the base of the panel 5 while the lower iron 28 is movable, and lies on the floor 2. Screws 29 turning in nuts 30 affixed to the iron 27 bear on the base of the iron 28 and permit precise adjustment of the position of the shuttering upon turning the heads 31 of the screws 29. It is necessary to understand that turning of the heads 31 permits a vertical adjustment of the shuttering assembly to occur, and in such case a corresponding adjustment of the swingable panel 8 is necessary.

Two other adjustments of the shuttering are provided at the base of the props 10 and will now be explained in detail. They concern:

1. The adjustment of the inclination of the shuttering, that is to say the adjustment of the verticality of the wall 1, which is obtained by the vertical displacement of each bracket 9 about the horizontal pivot 32 on the prop 10;

2. The adjustment of the lateral position of the shuttering assembly, that is to say the adjustment permitting the setting of the location of the wall 1 horizontally with respect to the floor 2.

The adjustment of the inclination of the shuttering may be obtained by any conventional screw device 51, such as a jack, having its lower end engaged threadingly within each foot 33 of each prop 10. A nut 52 affixed to the jack 51 permits the jack to be raised or lowered relative to the foot 33. Since pivot 32 extends through the jack 51, raising or lowering of the jack will raise or lower the bracket 9 connected to the pivot 32. Upon unscrewing the jack 51 relative to the foot 33, the height of the scaffolding is increased and the angle 34 of brackets 9 is increased, which effects a small swinging of the shuttering outwardly. Upon screwing the jack 51 into the foot 33, the height of the scaffolding is reduced and the angle 34 is decreased, with the result the shuttering is inclined toward the inside of the building. A pair of spaced stops 54, 53 are welded to opposite sides of each foot 33 to provide fork-like members for engagement with the inner end of each bracket 9, to secure each foot 33 against angular displacement when the shuttering is assembled.

Figure 5:
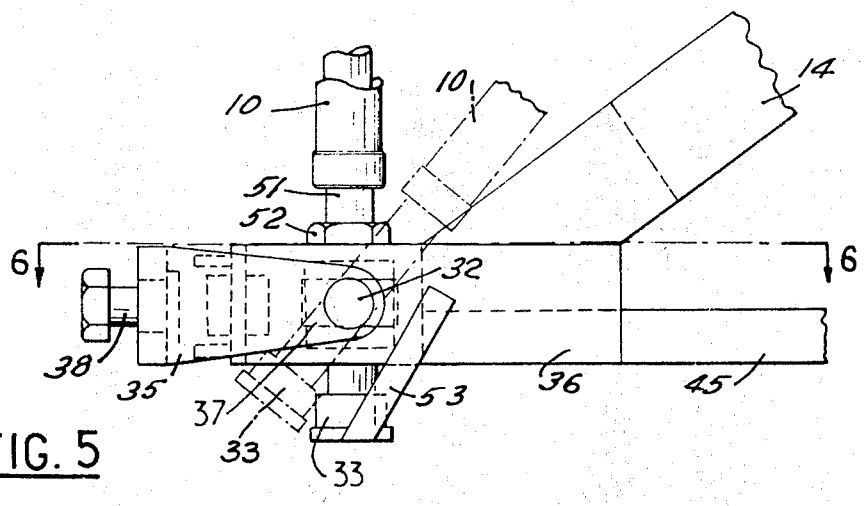
FIG. 5 is a partial view in side elevation of the connection between a prop and its brackets.
Figure 6:
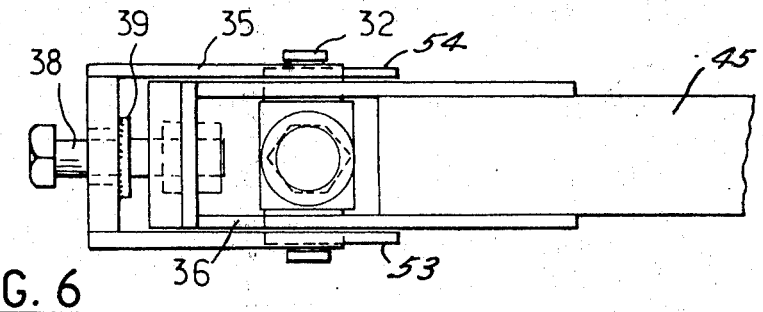
FIG. 6 is a section along the line 6—6 of FIG. 5.

The horizontal adjustment of the shuttering is effected with the aid of devices each comprised of an outer yoke or link member 35 (FIG. 6) pivoted to the horizontal pivot 32 of a prop 10, and an inner yoke or link member 36 integral with the brackets 9 and sliding on the pivot 32 by means of oblong slots 37 (FIG. 5). The outer link member 35 has a medial screw 38, for screwing in a nut 39 and for acting on the base of the link 36 so as to displace the latter longitudinally, parallel to the link 35 and relative to the pivot 32. It is to be understood that in operating the screw 38, when the prop 10 is locked between the floor 2 and the ceiling 4 by the screw adjustment of its hand lever 40, the brackets 9 can be displaced and, consequently, so can the shuttering assembly.

The brackets 9 are provided with a support 41 having a fork member 42 adapted to receive the folded prop 10 (FIG. 3) pivoting about the pivot 32. A transverse chute 43 (FIG. 1) is provided to permit guidance of the concrete material between the two panels 5 and 6. The chute 43 is supported at its upper end on a transverse bar 44 fixed to one or several members 16.

There will now be explained the manner in which the shuttering is used.

Figures 3, 4:
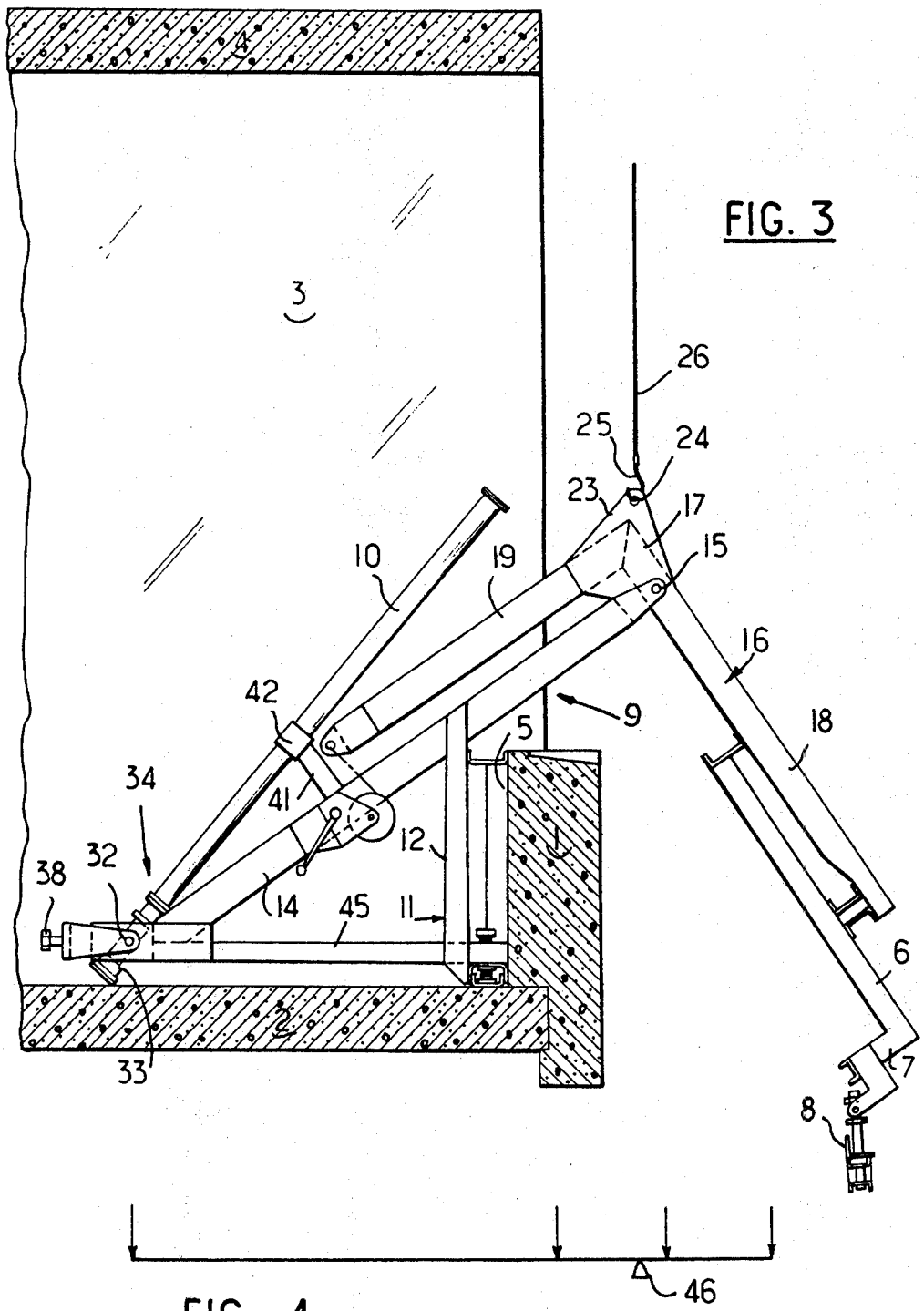
FIG. 3 is a view of the shuttering in side elevation in the deshuttering position.
FIG. 4 is a diagram showing the arrangement of forces on the bearing points of the shuttering in the deshuttering position when the structure is swung for disengagement.

The shuttering arrives in a folded manner as is shown in FIG. 3, that is to say the props 10 are in their retracted position folded on the forks 42. The upper side 19 of each member 16 is adjacent its hypotenuse 14 and the panels 6, 7 and 8, supported by the lower side 18 of each member 16, are spaced from the vertical side member 12 since the center of gravity of the assembly is situated below the hooking point 24, maintaining horizontal the lower side member 45. This is illustrated in FIG. 4 where it can be seen that the bearing point 46, indicating the center of gravity, rests outside the facade while the brackets 9 are located within the building.

While the shuttering is still suspended by the cable 26 of the crane, the props 10 are straightened and upon operation on the hand levers 40, are extended so that they are wedged between the floor 2 and the ceiling 4. Each foot 33 (FIG. 5) and screw 29 (FIG. 7) are then operated to effect vertical adjustment of the shuttering and to ensure its verticality. Then the screws 38 are operated to adjust the positioning of the inner vertical panel 5 in a definite manner. There remains then to unwind the winches 20 so that release of the traction on the cables 21 permits pivoting of the members 16 around the pivots 15, so that the panel 6 comes into place parallel to the panel 5. At the same time, the panel 7 comes into position horizontally under the floor 2. It is then necessary, from the lower story to raise the swingable panel 8 to locate it vertically and fix it definitely in height for the pouring.

The last operation consists in placing a threaded rod 47 (FIG. 1), which is inserted in the panels 5 and 6, and which is locked in position by nuts.

At this time, the props 10 being in place inwardly of the building and the assembly of the members 16, their lower sides 18 and the panels 6, 7 and 8 being lowered toward the building, the center of gravity shifts to the inside of the building so that the shuttering is in equilibrium.

Figure 2:
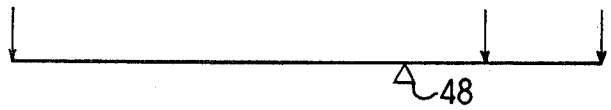
FIG. 2 is a diagram showing the arrangement of forces on the bearing points indicating that the shuttering is in a stable equilibrium.

The pouring of the concrete into the shuttering or framing mold does not alter this equilibrium and, as is shown in FIG. 2, the resultant bearing point 48, indicating the center of gravity of the shuttering and of the poured wall 1, is located inside of the building.

In order to dismantle the shuttering, the cable 26 of the crane is drawn so that the hook 25 can be placed in the hooking point 24 and the shuttering is suspended in this manner. The swingable panel 8 then is unlocked and folded back towards its base. One then proceeds with the operation of striking-off or dismantling, which can be effected simply by the pull of the lifting cable 26 after having released the props 10 and folded them on the forks 42. In effect, this upward pull has the effect of swinging the cross members 16 around the pivot point 15 and separating the panels 6, 7 and 8 from the outer face of the wall 1. This operation can be greatly facilitated by running the winches 20, which pulls on the ends 22 by the intermediary of the cables 21 to swing the upper sides 19 of the cross member 16 around the pivot points 15 which has the same results.

Subsequently the shuttering can be taken by the crane and placed at another point to form another wall.

What I claim is:

1. In a wall shuttering for forming in situ from poured concrete a portion of an outside wall of a building, a scaffolding supporting and adjusting shuttering elements forming a mold for the poured concrete, said scaffolding comprising:

a. at least two spaced brackets, said brackets extending from within the building outwardly of the building wall, when the shuttering is assembled in place preparatory to pouring concrete, b. each said bracket comprising a right-angled frame, each frame having vertical and horizontal sides and a hypotenuse, wherein 1. the vertical side of the frame supports an inner shuttering mold element at a location adjacent the inside of a portion of the wall to be formed.

2. the horizontal side extends inwardly from a lower portion of the vertical side.

3. and the hypotenuse extends beyond the vertical side outwardly of the building wall, when the shuttering is assembled, and supports outer shuttering mold elements, c. a prop for each bracket, d. a pivot connecting the inner end of each bracket with its prop, e. adjustment means connected to each bracket for adjusting selectively the vertical location of the scaffolding, and f. adjustment means mounted on each bracket for adjusting selectively the horizontal location of the scaffolding.

2. Wall shuttering as claimed in claim 1, wherein the brackets are provided with distal ends outwardly of the building, said distal ends each being provided with a suspension pivot for supporting said outer shuttering mold elements at a location adjacent the outside of a portion of the wall to be formed.

3. Wall shuttering as claimed in claim 2, further including:

a. a right-angled member pivotal about each suspension pivot and having a lower side member supporting the outer shuttering mold elements and an upper side member extending inwardly relative to the building, b. a gusset located adjacent the right angle of each right-angled member provided with a hooking point, and c. positioning means connected to at least one upper side member operable to adjust the position of the outer shuttering mold elements.

4. Wall shuttering as claimed in claim 3, wherein the positioning means connected to the upper side member of the right-angled member comprises:

a. a winch mounted on one of the brackets, and b. a cable extending from the winch and connected to said upper side member.

5. Wall shuttering as claimed in claim 3, wherein the hooking point of the gusset is an aperture adapted to receive the hook of a lifting means for removing the shuttering from the building.

6. Wall shuttering as claimed in claim 2, wherein:

a. the outer shuttering mold elements comprise an outer panel and a base panel, said panels forming a dihedral with said base panel extending inwardly from the outer panel in the direction of the building, b. a swingable mold element mounted pivotally on the base panel and c. adjustment means connected to the swingable mold element for selevitively adjusting the height of said elements.

7. Wall shuttering as claimed in claim 6, wherein the swingable mold element includes locking means for locking said panel in closed position to form the mold.

8. Wall shuttering as claimed in claim 1, wherein:

a. each prop is adapted to be disposed substantially vertically between a floor and ceiling of the building, when the shuttering is assembled in place preparatory to pouring concrete, b. each pivot connecting the props to the inner ends of the brackets has a horizontal axis, and c. the adjustment means for adjusting the scaffolding vertically and horizontally is operative to position the brackets selectively to locate the mold selectively preparatory to pouring concrete.

9. Wall shuttering as claimed in claim 8, wherein:

a. securing means are mounted on the brackets to receive and retain the props when the shuttering is removed from the building, and b. the horizontal axis pivots are mounted in a lower portion of the props, c. each said prop being pivotal about its said pivot from its substantially vertical position for reception by its securing means.

10. Wall shuttering as claimed in claim 8, wherein:

a. the adjustment means for adjusting the scaffolding vertically comprise screw means mounted on the prop and engaging the pivot, and b. the adjustment means for adjusting the scaffolding horizontally comprises 1. an outer link mounted pivotally of each horizontal axis pivot, 2. an inner link affixed to each bracket, said inner link having slots engaging the pivot with capacity for horizontal displacement relative thereto, and 3. a screw supported by each outer link and engaging each inner link for selectively displacing horizontally the inner link and the bracket affixed thereto to locate the mold selectively preparatory to pouring concrete.

* * * * *

UNITED STATES PATENT OFFICE

CERTIFICATE OF CORRECTION

PATENT NO. : 3,974,995
DATED : August 17, 1976
INVENTOR(S) : Guy Blonde

It is certified that error appears in the above-identified patent and that said Letters Patent are hereby corrected as shown below:

On the cover sheet, the following should be added:

-- [73] Assignee: Etablissement Outinord SA, Eaux, France --.

Column 1, line 6, change "farm" to --form--

Column 1, line 41, change "to" to --in--

Column 1, line 49, change the period to a colon

Column 1, line 67, after "vertical" insert --prop--

Column 2, line 34, change "brackets" to --bracket--

Column 3, line 5, after "15" insert --about--

Column 3, line 55, change "the", second occurrence, to --its--

Column 5, line 23, change "point" to --points--

Column 6, line 31, change "elements" to --element--

Signed and Sealed this

Twenty-first Day of December 1976

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,974,995 Dated August 17, 1976

Inventor(s) Guy Blonde

It is certified that error appears in the above-identified patent and that said Letters Patent are hereby corrected as shown below:

Page 1, after line [76] insert the following: --[73] Assignee: Etablissements OUTINORD SA, Saint Amand Les Eaux, France--

Column 1, line 6, change "farm" to --form--

Column 1, line 41, change "to" to --in--

Column 1, line 49, change the period to a colon

Column 1, line 67, after "vertical" insert --prop--

Column 2, line 34, change "brackets" to --bracket--

Column 3, line 5, after "15" insert --about--

Column 3, line 55, change "the", second occurrence, to --its--

Column 5, line 23, change "point" to --points--

Column 6, line 31, change "elements" to --element--

This certificate supersedes Certificate of Correction issued December 21, 1976.

Signed and Sealed this

Twelfth Day of April 1977

[SEAL]

*Attest:*

RUTH C. MASON
*Attesting Officer*

C. MARSHALL DANN
*Commissioner of Patents and Trademarks*